US007527662B2

(12) United States Patent
Sato

(10) Patent No.: US 7,527,662 B2
(45) Date of Patent: May 5, 2009

(54) ABRASIVE BODY AND METHOD OF MANUFACTURING THE SAME

(75) Inventor: Makoto Sato, Nagoya (JP)

(73) Assignee: Noritake Co., Limited, Nagoya-shi (JP)

( * ) Notice: Subject to any disclaimer, the term of this patent is extended or adjusted under 35 U.S.C. 154(b) by 494 days.

(21) Appl. No.: 11/039,840

(22) Filed: Jan. 24, 2005

(65) Prior Publication Data

US 2005/0150172 A1 Jul. 14, 2005

(51) Int. Cl.
*B24D 3/00* (2006.01)
*B24D 3/32* (2006.01)

(52) U.S. Cl. ..... 51/298; 51/307; 51/308; 51/309; 451/540; 451/548

(58) Field of Classification Search ..... 51/298, 51/307–309; 451/540, 548
See application file for complete search history.

(56) References Cited

U.S. PATENT DOCUMENTS 6,099,394 A * 8/2000 James et al. ..... 451/72
6,126,532 A * 10/2000 Sevilla et al. ..... 451/526
6,656,018 B1 * 12/2003 Hsu et al. ..... 451/41

FOREIGN PATENT DOCUMENTS

JP 5-69339 A 3/1993
JP A-09-254041 9/1997
JP 11-204467 A 7/1999
JP 11-327389 A 11/1999
JP 2001-205552 A 7/2001
JP A 2001-214154 8/2001
JP 2002-144220 A 5/2002

* cited by examiner

*Primary Examiner*—Michael A Marcheschi
(74) *Attorney, Agent, or Firm*—Oliff & Berridge, PLC

(57) ABSTRACT

An abrasive body for polishing includes a resin structure made of resin and a plurality of abrasive grains wherein a critical surface tension of the resin ranges from $1.6\times10^{-2}$ to $4.0\times10^{-2}$ N/m.

8 Claims, 3 Drawing Sheets

1.0μm

ABRASIVE BODY AND METHOD OF MANUFACTURING THE SAME

FIELD OF THE INVENTION

The present invention relates to an abrasive body and a method of manufacturing the same for polishing a work piece such as a semiconductor wafer mainly by a Chemical Mechanical Polishing (CMP) method.

DESCRIPTION OF RELATED ART

In general, a plurality of chips are formed on a semiconductor wafer and cut them in the terminal step to manufacture the VLSI (Very large scale integration) chips. Late development in VLSI manufacturing technology leads to ultra integration and advanced multilayer interconnection. This demands planarization of the whole surface (global planarization) of the wafer in steps to form each layer. The Chemical Mechanical Polishing (CMP) method is one of the means to realize the planarization of the whole surface of the wafer. In the CMP method the wafer is forcedly rotated being pressed to an unwoven fabric affixed on the polishing table or an polishing pad such as a foam pad, and polishing is proceeded on the wafer receiving a slurry, namely, a concentrated suspension of such as alkaline solution in which fine powders disperse, including fine abrasive grains (free abrasive grains). The CMP method allows precise polishing by chemical polishing with a chemical agent as a liquid and mechanical polishing with free abrasive grains.

The conventional CMP method has a disadvantage of requiring a mass of slurry because the method needs a continuous supply of the slurry for the polishing pad. The used slurry considerably costs for a specific treatment because it is the industrial waste and the environmental protection cannot welcome increasing of the industrial wastes. Furthermore, using abrasive grains compels users to meet heavy expenditure in polishing by the CMP method and a number of the abrasive grains are wasted because not all the grains in the slurry contribute to polishing. Thus the method has another disadvantage of being uneconomical.

To overcome these disadvantages a certain solid abrasive body for polishing by the CMP method without any slurry is invented. JP 2001-214154A, for example, discloses composition for a polishing pad and a polishing pad using the same. This is an abrasive body including abrasive grains of such as cerium oxide and a water-soluble material such as dextrin in a water-insoluble material such as a thermoplastic polymer. The abrasive grains removed from the abrasive body serve as free abrasive grains, namely, free grains are supplied not from the outside but by the abrasive body itself in polishing by the CMP method. However, the trial for polishing with the disclosed abrasive body manufactured by the present inventor has unsatisfactorily resulted. The disclosed abrasive body is inferior in the disclosed method than in the conventional polishing by the CMP method with the slurry in efficiency of polishing and is insufficient in the quality of the polished surface other than the abrasive body with abrasive grains such as cerium oxide and manganese dioxide, which are relatively superior in the polishing performance.

It is therefore a first object of the present invention to provide an abrasive body for polishing by a CMP method, which is sufficient in efficiency of polishing and quality of the polished surface, and is a second object of the invention to provide a method of manufacturing the abrasive body.

The present inventor supposes that the disadvantages of the conventional abrasive body in efficiency of polishing and quality of the polished surface described above are caused by the difficulty in removing of abrasive grains included in the abrasive body from the resin structure of the body. In the CMP method, polishing of the workpiece is conducted by the relative movement pressing the abrasive body and the workpiece each other with free abrasive grains therebetween. Consequently the method without the slurry requires necessary and sufficient abrasive grains supplied by the abrasive body itself. The inventor has invented an abrasive body preferably supplying free abrasive grains by itself with the abrasive grains which likely to remove from the resin structure of the abrasive body.

SUMMARY OF THE INVENTION

The first object indicated above may be achieved according to a first aspect of the invention, which provides an abrasive body for polishing mainly by a Chemical Mechanical Polishing (CMP) method comprising: (1) a resin structure made of resin; and (2) a plurality of abrasive grains; (3) wherein a critical surface tension of the resin ranges from $1.6\times10^{-2}$ to $4.0\times10^{-2}$ N/m.

According to the first aspect of the invention, the abrasive grains are likely to remove from the resin structure and the abrasive body preferably supplies free abrasive grains between the abrasive body and the workpiece in polishing by the CMP method because the critical surface tension of the resin ranges from $1.6\times10^{-2}$ to $4.0\times10^{-2}$ N/m and the abrasive grains are bonded to the resin structure by a necessary and sufficient bonding strength. Thus an abrasive body which is preferable in efficiency of polishing and quality of the polished surface without any slurry for polishing by the CMP method is provided. With the resin having the critical surface tension smaller than $1.6\times10^{-2}$ N/m the efficiency of polishing of the abrasive body lowers because the abrasive body repels necessary water for polishing by the CMP method. With the resin having the critical surface tension larger than $4.0\times10^{-2}$ N/m the abrasive grains are hard to remove from the resin structure.

The first object indicated above may be achieved according to a second aspect of the invention, which provides the abrasive body defined in the first aspect of the invention, further comprising a plurality of pores and wherein the abrasive grains are located in the pores. According to the second aspect of the invention, some abrasive grains are affixed to an internal wall of the pore on a part of the abrasive grain, and the other grains are located apart from the resin structure in the pore. This aspect has an advantage of precise polishing such as without any scratches because the abrasive grains are likely to remove from the resin structure in polishing by the CMP method and a plurality of the abrasive grains appropriately disperse in the pores.

The first object indicated above may be achieved according to a third aspect of the invention, which provides the abrasive body defined in any one of the first and second aspects of the invention, wherein a volume rate of the abrasive grains to the abrasive body ranges from 20% to 50%. The first object indicated above may be achieved according to a fourth aspect of the invention, which provides the abrasive body defined in any one of the first through third aspects of the invention, wherein a weight rate of the abrasive grains to the abrasive body ranges from 51% to 90%. According to the third and fourth aspects of the invention, the abrasive body is superior in efficiency of polishing and quality of the polished surface in polishing by the CMP method and easy of casting in manufacturing. The abrasive body having less than 20% of the volume rate or less than 51% of weight rate of the abrasive grains is inferior in efficiency of polishing and quality of the polished surface. The abrasive body having over 50% of the volume rate or over 90% of the weight rate of the abrasive grains is difficult of casting in manufacturing.

The first object indicated above may be achieved according to a fifth aspect of the invention, which provides the abrasive body defined in any one of the first through fourth aspects of the invention, wherein the resin structure is made of resin including at least one material selected from a group of polyvinyl fluoride, vinyl fluoride-hexafluoropropylene copolymer, polyvinylidene fluoride, vinylidene fluoride-hexafluoropropylene copolymer, polyethylene and polymethyl methacrylate. According to the fifth aspect of the invention, provided is advantageous and useful abrasive body having a resin structure with a necessary and sufficient critical surface tension and a superior material strength.

The first object indicated above may be achieved according to a sixth aspect of the invention, which provides the abrasive body defined in any one of the first through fifth aspects of the invention, wherein the abrasive grains are made of at least one material selected from a group of silicon oxide, cerium oxide, aluminum oxide, zirconium oxide, titanium oxide, manganese oxide, barium carbonate, chromium oxide and iron oxide. According to the sixth aspect of the invention, provided is an advantageous and useful abrasive body having abrasive grains suitable for each workpiece in hardness.

The first object indicated above may be achieved according to a seventh aspect of the invention, which provides the abrasive body defined in any one of the first through sixth aspects of the invention, which is made in a form of a disc.

The second object indicated above may be achieved according to a eighth aspect of the invention, which provides a method of manufacturing an abrasive body for polishing mainly by a Chemical Mechanical Polishing (CMP) method, the abrasive body including a resin structure made of resin and a plurality of abrasive grains comprising: (1) a dissolving step for dissolving the resin in a solvent to produce a flow material; (2) a mixing/agitating step for mixing the abrasive grains with the flow material and agitating a mixture of the abrasive grains and the flow material; and (3) a casting step for casting the mixture using a mold.

According to the eighth aspect of the invention, the abrasive body including a resin structure made of resin and a plurality of abrasive grains is manufactured as below. The resin for the resin structure is dissolved in the solvent to produce the flow material in the dissolving step. The abrasive grains are mixed with the flow material and the mixture of the abrasive grains and the flow material is agitated in the mixing/agitating step. The mixture, namely, the flow material including the abrasive grains is cast into a cast fixture using the mold in the casting step. The resin in the cast mixture cures and at the same time the solvent separated from the resin is immured by the resin to form a plurality of pores in the resin structure. And the mixed and agitated abrasive grains are dispersedly included in the pores. Then provided is the abrasive body having a plurality of pores with the abrasive grains in. Such an abrasive body has some of abrasive grains affixed to the internal wall of the pore on a part of the abrasive grain, and the other grains located apart from the resin structure in the pores. This has an advantage of precise polishing such as without any scratches because the abrasive grains are likely to remove from the resin structure in polishing by the CMP method and a plurality of the abrasive grains appropriately disperse in the pores. Thus provided is a method of manufacturing an abrasive body that is preferable in efficiency of polishing and quality of the polished surface without any slurry for polishing by the CMP method.

The second object indicated above may be achieved according to a ninth aspect of the invention, which provides the method defined in the eighth aspect of the invention, wherein a critical surface tension of the resin ranges from $1.6\times10^{-2}$ to $4.0\times10^{-2}$ N/m. The second object indicated above may be achieved according to a tenth aspect of the invention, which provides the method defined in the eighth or ninth aspect of the invention, wherein the abrasive body further comprises a plurality of pores and the abrasive grains are located in the pores.

The second object indicated above may be achieved according to a eleventh aspect of the invention, which provides the method defined in any one of the eighth through tenth aspects of the invention, wherein a volume rate of the abrasive grains to the abrasive body ranges from 20% to 50%. The second object indicated above may be achieved according to a twelfth aspect of the invention, which provides the method defined in any one of the eighth through eleventh aspects of the invention wherein a weight rate of the abrasive grains to the abrasive body ranges from 51% to 90%. Thus provided is a method of manufacturing an abrasive body that is preferable in efficiency of polishing and quality of the polished surface in polishing by the CMP method and easy to cast the mixture and to form the abrasive body in the casting step.

The second object indicated above may be achieved according to a thirteenth aspect of the invention, which provides the method defined in any one of the eighth through twelfth aspects of the invention, wherein the resin structure is made of resin including at least one material selected from a group of polyvinyl fluoride, vinyl fluoride-hexafluoropropylene copolymer, polyvinylidene fluoride, vinylidene fluoride-hexafluoropropylene copolymer, polyethylene and polymethyl methacrylate. The second object indicated above may be achieved according to a fourteenth aspect of the invention, which provides the method defined in any one of the eighth through thirteenth aspects of the invention, wherein the abrasive grains are made of at least one material selected from a group of silicon oxide, cerium oxide, aluminum oxide, zirconium oxide, titanium oxide, manganese oxide, barium carbonate, chromium oxide and iron oxide. The second object indicated above may be achieved according to a fifteenth aspect of the invention, which provides the method defined in any one of the eighth through fourteenth aspects of the invention, wherein the abrasive body is made in a form of a disc.

DETAILED DESCRIPTION OF EXEMPLARY EMBODIMENTS

Figure 1:
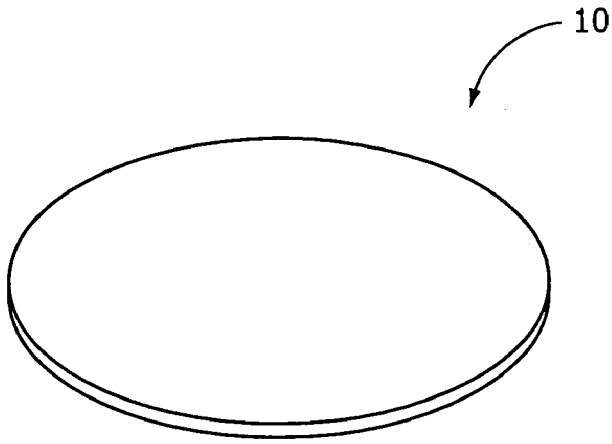
FIG. 1 illustrates an abrasive body in an embodiment according to the invention in a perspective view.

Hereinafter, there will be described an abrasive body by reference to the drawings. FIG. 1 illustrates an abrasive body 10 in an embodiment according to the invention in a perspective view. As shown in FIG. 1, the abrasive body 10 in the embodiment is provided with a resin structure 12 and a plurality of abrasive grains 14 in a form of disc. The body 10 has the dimensions, for example, of approximately 300 mm in diameter and approximately 5 mm in thickness. The abrasive body 10 is affixed to a polishing table 20 of a polishing apparatus 18 as described below and mostly used for polishing in the CMP method.

For the resin structure 12 synthetic resin materials of a critical surface tension ranging from $1.6\times10^{-2}$ to $4.0\times10^{-2}$ N/m are preferably used. The critical surface tension means the surface tension at $\theta=0$, namely, $\cos\theta=1$ on an extrapolated line determined on the basis of the plot of the contact angle $\theta$ and the surface tension $\gamma_L$ of the low-molecular liquid on the surface of the high-molecular material. The structure 12 is made of resin including at least one material selected from a group of polyvinyl fluoride, vinyl fluoride-hexafluoropropylene copolymer, polyvinylidene fluoride, vinylidene fluoride-hexafluoropropylene copolymer, polyethylene and polymethyl methacrylate. The polyethylene of molecular weight of more than one million is desirable. The abrasive grain 14 has preferably a diameter ranging from 0.005-10 μm and is made of at least one material selected from a group of silicon oxide (or silica), cerium oxide (or ceria), aluminum oxide (or alumina), zirconium oxide (or zirconia), titanium oxide (or titania), manganese oxide, barium carbonate, chromium oxide and iron oxide. As silicon oxide, for example, fumed silica (fine particles of silicon oxide produced from such as silicon tetrachloride or chlorosilane burnt at high temperature under the presence of hydrogen and oxygen) is preferably used. The volume rate of the abrasive grain 14 to the abrasive body 10 preferably ranges from 20% to 50% and the weight rate preferably ranges from 51% to 90%.

Figure 2:
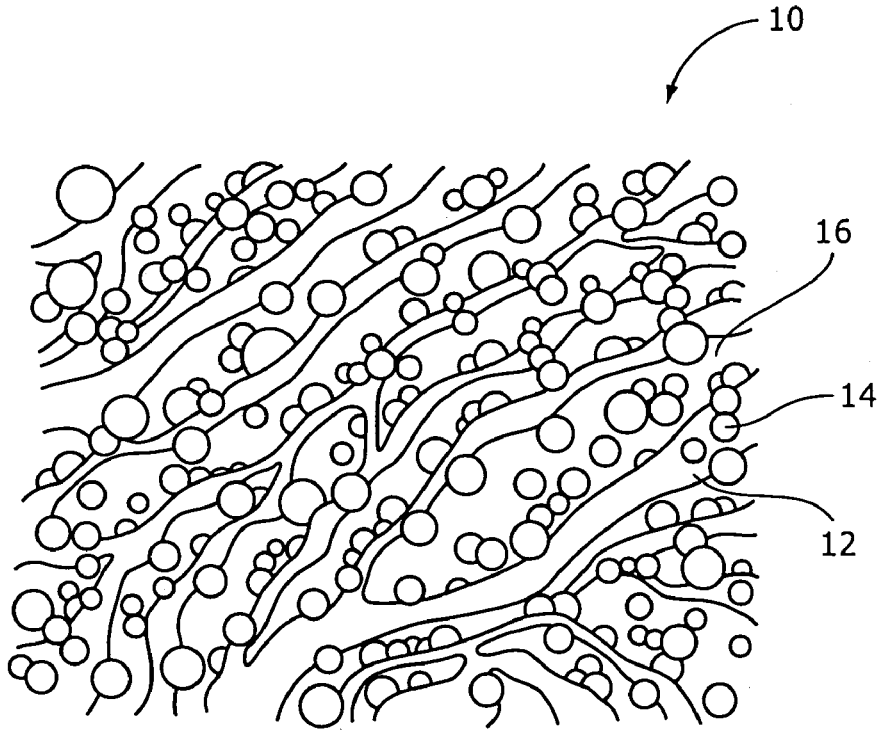
FIG. 2 illustrates a surface of the abrasive body of FIG. 1 through a scanning electron microscope in an enlarged view.

FIG. 2 illustrates a surface of the abrasive body 10 in the present embodiment through a scanning electron microscope in an enlarged view. As shown in FIG. 2 the resin structure 12 has a fibriform construction in which the average sectional diameter of the fibers is, for example, approximately 0.05 μm and the average diameter of the abrasive grains 14 is, for example, approximately 0.25 μm. Some abrasive grains are affixed to an internal wall of the pore on a part of the abrasive grain, and the other grains are located apart from the resin structure in the pore. That is, the average sectional area of the fibers of the resin structure 12 is, for example, approximately 1/10-1/3 of the average diameters of the abrasive grains 14. The spaces among the fibers of the resin structure 12 may be regarded as a plurality of the pores 16, and consequently, the abrasive grains 14 are regarded as being located in the pores 16. The volume rate of the pore 16 to the abrasive body is, for example, approximately 15%-60%.

Figure 3:
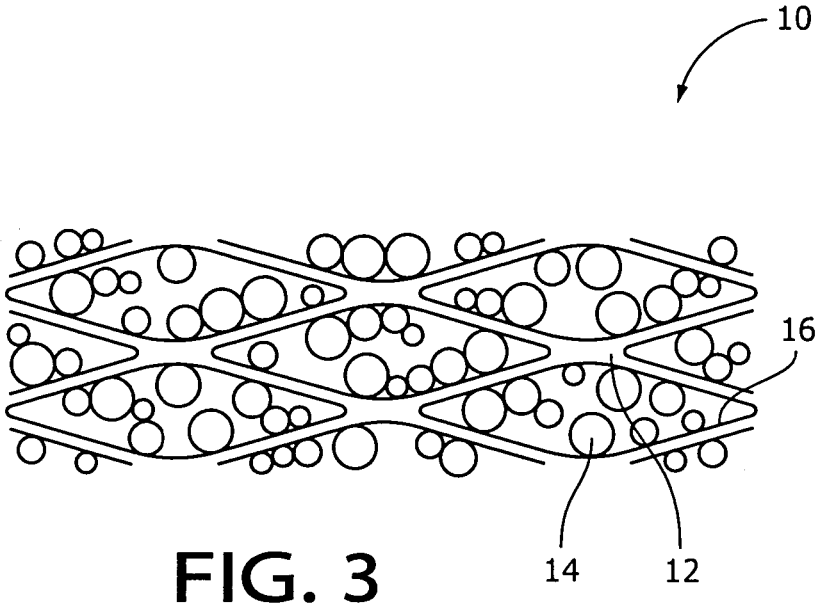
FIG. 3 illustrates a structure of the abrasive body of FIG. 1 in a diagram.

FIG. 3 illustrates a structure of the abrasive body 10 in the present embodiment in a diagram. As shown in FIG. 3 some of the abrasive grains 14 are affixed to the internal wall of the pore 16 on a part of the abrasive grain, and the other of the grains 14 are located apart from the resin structure 12 in the pore 16. Thus, the abrasive grains 14 are likely to remove from the resin structure 12 in the abrasive body 10 in polishing by the CMP method described below in the present embodiment. And the abrasive body 10 preferably supplies free abrasive grains, namely, removed abrasive grains between the abrasive body 10 and the workpiece because the critical surface tension of the resin ranges from $1.6\times10^{-2}$ to $4.0\times10^{-2}$ N/m and the abrasive grains 14 are bonded to the resin structure 12 by a necessary and sufficient bonding strength. Although the conventional polishing in the CMP method requires a supply of slurry including such as colloidal silica, the polishing in the CMP method using the abrasive body 10 in the present embodiment requires no slurry but the polishing liquid without free abrasive grains.

Figure 4A:
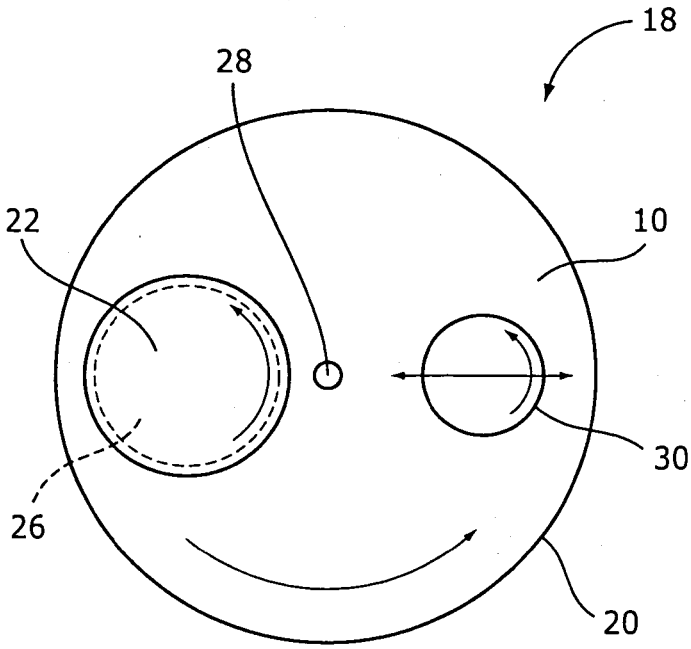
FIG. 4A illustrates in brief a polishing apparatus in the CMP method using the abrasive body of FIG. 1 in a plan view as seen from the axial direction of the polishing table.
Figure 4B:
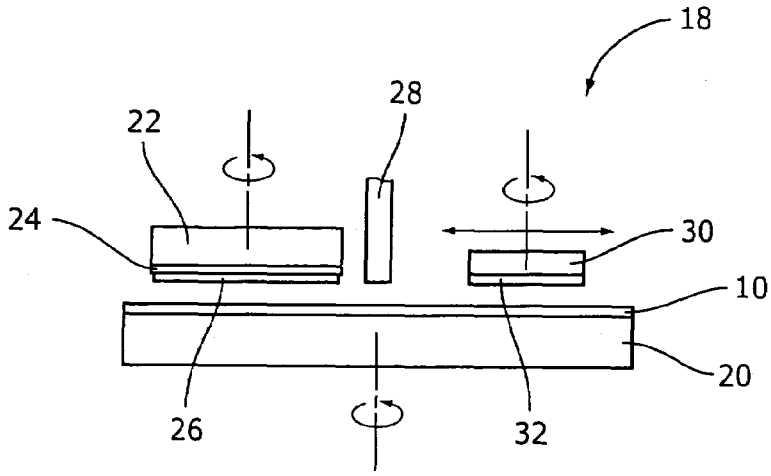
FIG. 4B illustrates in brief the same in a front view.

FIG. 4A illustrates in brief a polishing apparatus 18 in the CMP method using the abrasive body 10 in the present embodiment in a plan view as seen from the axial direction of a polishing table 20 and FIG. 4B illustrates in brief the same in a front view. As shown in FIGS. 4A and 4B the polishing apparatus 18 is provided with the polishing table 20 supported as pivotally rotatable about its axis and the polishing table 20 is rotated in the arrowed direction in FIG. 4A by a table driving motor (not shown). On the upper surface of the polishing table 20, that is, a surface on which a workpiece is pressed, the abrasive body 10 is affixed. Above and near the polishing table 20 a workpiece holder 22 to hold the workpiece is supported rotatably about its axis and movably in the axial direction. The workpiece holder 22 is rotatable in the arrowed direction in FIG. 4A by a workpiece driving motor (not shown) and absorbedly holds a wafer 26 as the workpiece on the lower and opposite surface to the abrasive body 10 through the absorption layer 24. Near the workpiece holder 22 is provided a polishing liquid supply nozzle 28 for supplying the polishing liquid of alkaline or acid solution from a tank (not shown) in polishing.

In polishing by the CMP method the polishing table 20 and the affixed abrasive body 10 to the table 20, and the workpiece holder 22 and the wafer 26 absorbedly held by the holder 22 are rotated about each axis by the polishing table driving motor or workpiece driving motor, and being supplied with a polishing liquid such as amine solution through the polishing liquid supply nozzle 28 to the surface of the abrasive body 10, the wafer 26 absorbedly held by the holder 22 is pressed. Thus, the polished and opposite surface to the abrasive body 10 of the wafer 26 is polished with the polishing liquid (the chemical polishing) and the abrasive grains 14 (the mechanical polishing) supplied by the abrasive body 10 to be even.

As shown in FIGS. 4A and 4B, the polishing apparatus 18 is provided with an adjusting tool holder 30 which is pivotally rotatable about an axis parallel to the axis of the polishing table 20 and movable in the axial direction and the radial direction of the polishing table 20, and an abrasive body adjusting tool 32 which is held on the lower and opposite surface to the abrasive body 10. The adjusting tool holder 30 and the abrasive body adjusting tool 32 held by the holder 30 are pressed on the abrasive body 10 with being rotated by an adjusting tool driving motor (not shown) and reciprocated in the radial direction of the polishing table 20, as occasion demands, to adjust the surface of the abrasive body 10 for polishing.

Figure 5:
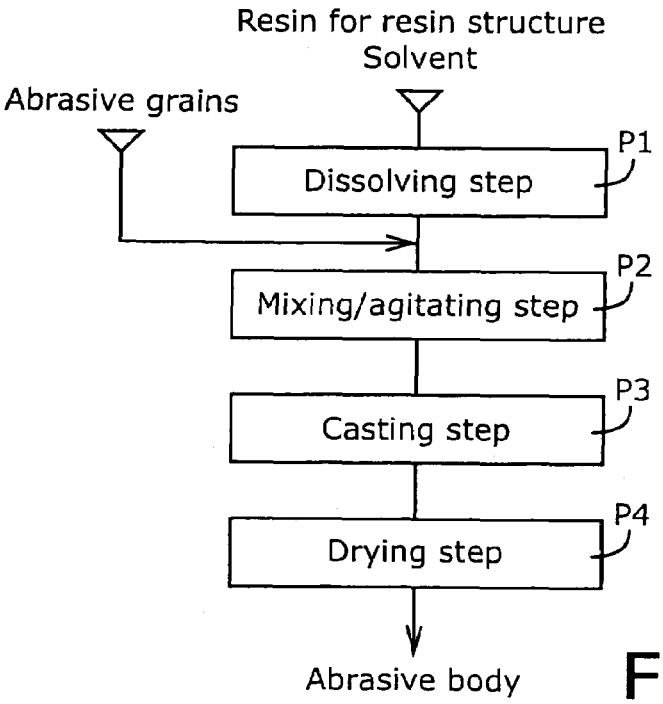
FIG. 5 illustrates a method of manufacturing the abrasive body of FIG. 1 in a diagram.

FIG. 5 illustrates a method of manufacturing the abrasive body 10 in a diagram. Hereinafter, there will be described a method of manufacturing an abrasive body by reference to the drawing.

First, resin for the resin structure 12 is dissolved in a solvent such as DMF (dimethylformamide) in a dissolving step P1. A flow material is prepared from the resin for the resin structure 12 and the solvent, for example, in an agitator in which the resin and the solvent are mixed and agitated with being heated at approximately 40-60° C. The volume ratio of the resin for the resin structure 12 and the solvent preferably stands approximately 1 to 5. The solvent is required for forming the pores 16 in the resin structure 12 in the casting step P3 described below. The quantity of the mixed solvent in the dissolving step P1 is reflected on the volume ratio of the pores 16 in the manufactured abrasive body 10. The volume ratio instanced above fulfills that of about 30%-40% of the pores 16 of the manufactured body 10.

Next, the flow material are mixed with the abrasive grains 14 and agitated in the mixing/agitating step P2. The agitator used in the dissolving step P1, for example, is preferably employed for mixing and agitating the flow material with the abrasive grains 14. The quantity of the added abrasive grains 14 is preferably determined as ranging from 20% to 50% of the volume rate of the abrasive grains 14 to the abrasive body 10 and as ranging from 51% to 90% of the weight rate of the abrasive grains 14 to the abrasive body 10. The abrasive body 10 having less than 20% of the volume rate or less than 51% of weight rate of the abrasive grains 14 is inferior in efficiency of polishing (removal rate) and quality of the polished surface (surface roughness). The abrasive body having over 50% of the volume rate or over 90% of the weight rate of the abrasive grains 14 is difficult of casting in the casting step P3 described below.

The flow material prepared in the dissolving step P1 and the mixing/agitating step P2 is cast using a mold in the casting step P3. The resin for the resin structure 12 in the cast mixture cures and at the same time the solvent separated from the resin is immured by the resin structure 12 to form a plurality of pores 16 in the resin structure 12. Preferably the mixed and agitated abrasive grains 14 are dispersedly included in the pores 16. The solvent remained within the pores 16 in the resin structure 12 are then volatilized in the following drying step P4. Manufacturing of the abrasive body 10 in the present embodiment is completed through these steps.

Experiment

The inventor experimented in order to examine the effect of the present invention. Samples 1 and 2 of the embodiments according to the present invention and Sample 3 as the compared were manufactured under the manufacturing steps in FIG. 5. Samples 1-3 were tested for polishing in the polishing apparatus of the CMP method in FIG. 4. Further, the results of the polishing test of Samples 1-3 were compared to a result of a sample tested with the conventional polishing pad and slurry. The specifications of Samples 1-3, the condition and the results are given as follows. Scratches were judged with human eyes and its judgment is given in the table of the Results.

[Samples]

| | Resin for Resin Structure | Abrasive Grain*3 | Rate of Pores |
|---|---|---|---|
| Sample 1 | PVDF*1 (35 vol %) | Silica (28 vol %) | 37 vol % |
| Sample 2 | PVDF (28 vol %) | Silica (36 vol %) | 36 vol % |
| Sample 3 | Epoxy Resin*2 (60 vol %) | Silica (20 vol %) | 20 vol % |

Notes:
*1Polyvinylidene fluoride
*2Bisphenol A series epoxy and cycloaliphatic amine curing agent
*3The average diameter of the abrasive grain is 0.25 μm.

[Condition]

Dimension of abrasive body: 300 mm in diameter and 5 mm in thickness

Rotation of abrasive body: 30 r.p.m. [0.5 $s^{-1}$]

Work piece 1: Silicon bare wafer

Workpiece 2: Oxide film silicon wafer

Dimension of workpiece: 100 mm in diameter and 0.6 mm in thickness

Rotation of workpiece: 30 r.p.m. [0.5 $s^{-1}$]

Pressure on surface in polishing: 100 gf/$cm^2$ [9.8 kPa]

Polishing liquid 1: KOH solution (0.01 N, pH 11.5)

Polishing liquid 2: Piperazine solution (0.4 wt %, pH 11.5)

Quantity of polishing liquid: 10 ml/min [0.167 $cm^3$/s]

Polishing pad: Expanded polyurethane pad

Slurry for polishing: pH 10.8, fumed silica of 80 nm in average diameter (12 wt %)

[Results]

| Test No. | Abrasive Body (Sample No.) | Polishing Liquid No. | Work-piece No. | Removal Rate (nm/min) | Surface Roughness Ra ($\times 10^{-1}$ nm) | Scratches |
|---|---|---|---|---|---|---|
| 1 | 1 | Pure Water | 1 | 78 | 8.2 | None |
| 2 | 1 | 1 | 1 | 100 | 12.9 | None |
| 3 | 2 | Pure Water | 1 | 92 | 7.9 | None |
| 4 | 2 | 1 | 1 | 104 | 13.2 | None |
| 5 | 2 | 2 | 1 | 134 | 10.4 | None |
| 6 | 2 | Pure Water | 2 | 22 | 3.5 | None |
| 7 | 2 | 1 | 2 | 30 | 2.8 | None |
| 8 | 3 | Pure Water | 1 | 2 | 4.2 | Scratches |
| 9 | 3 | 1 | 1 | 23 | 19.4 | Scratches |
| 10 | 3 | Slurry | 1 | 21 | 14.9 | Scratches |
| 11 | Pad*4 | Slurry | 1 | 90 | 6.5 | None |
| 12 | Pad*4 | Slurry | 2 | 24 | 3.2 | None |

Notes:
*4Polishing pad

Test Nos. 1-7 show the results of polishing using Sample 1 or 2 of an embodiment according to the present invention, Test Nos. 8-10 show the results of polishing using Sample 3 of the comparative sample and Test Nos. 11 and 12 show the results of polishing using the conventional polishing pad and slurry. Thus the tests using Sample 1 or 2 with the pure water as the polishing liquid show substantially the same efficiency and quality of the polished surface in polishing as using the conventional polishing pad and slurry in both cases that the silicon bare wafer or the oxide film silicon wafer is selected for the workpiece. And the tests using Sample 1 or 2 with KOH solution or piperazine solution as the polishing liquid show superior efficiency and quality of the polished surface in polishing to ones using the conventional polishing pad and slurry in both cases that a silicon bare wafer or an oxide film silicon wafer is selected for a work piece. The tests using Sample 3, the comparative sample, show inferior efficiency and quality of the polished surface in polishing to ones using the conventional polishing pad and slurry in all cases and scratches on the polished surface of the workpiece. This is considered that it is caused by that the abrasive grains firmly bond to the resin structure made from epoxy resin, which its critical surface tension is larger than $4.0\times10^{-2}$ N/m, and the abrasive grains are difficult to remove from the resin structure. These results of the tests say the abrasive body according to the present invention allows polishing by the CMP method in preferable efficiency of polishing and quality of the polished surface without any slurry.

According to this embodiment, the abrasive grains 14 are likely to remove from the resin structure 12 and the abrasive body 10 preferably supplies free abrasive grains between the abrasive body 10 and the wafer 26 as a workpiece in polishing by the CMP method because the critical surface tension of the resin ranges from $1.6\times10^{-2}$ to $4.0\times10^{-2}$ N/m and the abrasive grains 14 are bonded to the resin structure 12 by a necessary and sufficient bonding strength. Thus an abrasive body 10 which is preferable in efficiency of polishing and quality of the polished surface without any slurry for polishing by the CMP method is provided.

The abrasive body 10 preferably includes a plurality of pores 16 and the abrasive grains 14 are located in the pores 16. Some of the abrasive grains 14 are affixed to an internal wall of the pore 16 on a part of the abrasive grain 14, and the other grains are located apart from the resin structure 12 in the pore 16. This aspect has an advantage of precise polishing such as without any scratches because the abrasive grains 14 are likely to remove from the resin structure 12 in polishing by the CMP method and a plurality of the abrasive grains 14 appropriately disperse in the pores 16.

The volume rate of the abrasive grains 14 to the abrasive body 10 preferably ranges from 20% to 50%. The weight rate of the abrasive grains 14 to the abrasive body 10 preferably ranges from 51% to 90%. Consequently the abrasive body 10 is superior in efficiency of polishing and quality of the polished surface in polishing by the CMP method and easy of casting in manufacturing.

The resin structure 12 is preferably made of resin including at least one material selected from a group of polyvinyl fluoride, vinyl fluoride-hexafluoropropylene copolymer, polyvinylidene fluoride, vinylidene fluoride-hexafluoropropylene copolymer, polyethylene and polymethyl methacrylate. Provided is an advantageous and useful abrasive body 10 having a resin structure 12 with a necessary and sufficient critical surface tension and a superior material strength.

The abrasive grains 14 are preferably made of at least one material selected from a group of silicon oxide, cerium oxide, aluminum oxide, zirconium oxide, titanium oxide, manganese oxide, barium carbonate, chromium oxide and iron oxide. Provided is an advantageous and useful abrasive body 10 having abrasive grains 14 suitable for each wafer 26 in hardness.

According to the present embodiment, the resin for the resin structure 12 is dissolved in the solvent to produce the flow material in the dissolving step P1. The abrasive grains 14 are mixed with the flow material and the mixture of the abrasive grains 14 and the flow material is agitated in the mixing/agitating step P2. The mixture, namely, the flow material including the abrasive grains 14 is cast into a cast mixture using the mold in the casting step P3. The resin in the cast mixture cures and at the same time the solvent separated from the resin is immured by the resin to form a plurality of pores 16 in the resin structure 12. And the mixed and agitated abrasive grains are dispersedly included in the pores 16. Then provided is the abrasive body 10 having a plurality of pores 16 with the abrasive grains 14 in. Such an abrasive body 10 has some of the abrasive grains 14 affixed to the internal wall of the pore 16 on a part of the abrasive grain 14, and the other grains located apart from the resin structure 12 in the pores 16. This has an advantage of precise polishing such as without any scratches because the abrasive grains 14 are likely to remove from the resin structure 12 in polishing by the CMP method and a plurality of the abrasive grains 14 appropriately disperse in the pores 16. Thus provided is a method of manufacturing an abrasive body 10 that is preferable in efficiency of polishing and quality of the polished surface without any slurry for polishing by the CMP method.

The volume rate of the abrasive grains 14 to the abrasive body 10 preferably ranges from 20% to 50%. The weight rate of the abrasive grains 14 to the abrasive body 10 preferably ranges from 51% to 90%. Thus provided is a method of manufacturing an abrasive body 10 that is preferable in efficiency of polishing and quality of the polished surface in polishing by the CMP method and easy to cast the mixture and to form the abrasive body 10 in the casting step.

While the invention has been described in its exemplary embodiment, the invention may be otherwise embodied.

For instance, although the resin structure 12 has a fibriform construction in the above embodiment, it is a preferable embodiment and not limited to the fibriform construction. The resin structure in the abrasive body according to the present invention may be one having pores in the bubble form, which the pores are communicated one another. Such a resin structure as free abrasive grains are supplied not from the outside but by the resin structure itself in polishing by the CMP method may be adopted.

Although the mixing/agitating step P2 follows the dissolving step P1 in the above embodiment, the abrasive body 10 may be manufactured through a combined step of the dissolving step P1 and the mixing/agitating step P2 to mix the resin for the resin structure 12, the abrasive grains 14 and the solvent substantially at the same time and agitate a mixture of them. And the dissolving step P1 may follow the mixing/agitating step P2. In this case, the resin for the resin structure 12 is dissolved in the solvent after the abrasive grains 14 are mixed with the resin for the resin structure 12 or the solvent and the mixture is agitated.

While DMF (dimethylformamide) is employed as a solvent in the dissolving step P1 in the embodiment, N-methyl-2-pyrrolidone, for example, may be employed. Any available solvent may be employed for preferably dissolving the resin for the resin structure 12 in the dissolving step P1, forming a plurality of pores 16 in the mixing/agitating step P2 and being volatilized in the drying step P4. A continuous casting method to continuously cast the flow material on the conveyor belt may be employed.

While the alkaline solution without free abrasive grains and others are used as a polishing liquid for polishing by the CMP method with the abrasive body 10 in the embodiment, the slurry may be used. In that case, the slurry with a few abrasive grains is expected to allow polishing which is sufficient in efficiency of polishing and quality of the polished surface, or superior in efficiency of polishing and quality of the polished surface to the conventional polishing pad and slurry. The abrasive body according to the present invention may be employed for polishing with neutral liquid such as pure water and for a variety of polishings.

While the abrasive body 10 is used for polishing of the semiconductor wafer such as the silicon bare wafer or oxide film silicon wafer in the embodiment, the body 10 according to the present invention may be used for polishing of any workpiece such as the glass substrate for electronic devices on condition that the abrasive body 10 according to the present invention is effective.

It is to be understood that the present invention may be embodied with other changes, improvements, and modifications that may occur to a person skilled in the art without departing from the scope and spirit of the invention defined in the appended claims.

What is claimed is:

1. An abrasive body for polishing comprising:

a resin structure made of resin of which critical surface tension ranges from $1.6\times10^{-2}$ to $4.0\times10^{-2}$ N/m, and which has a fibriform construction provided with a plurality of pores communicated with each other; and a plurality of abrasive grains being located in the pores;

wherein a volume rate of the abrasive grains to the abrasive body ranges from 20% to 50%.

2. An abrasive body for polishing comprising:

a resin structure made of resin of which critical surface tension ranges from $1.6\times10^{-2}$ to $4.0\times10^{-2}$ N/m, and which has a fibriform construction provided with a plurality of pores communicated with each other; and a plurality of abrasive grains being located in the pores;

wherein a weight rate of the abrasive grains to the abrasive body ranges from 51% to 90%.

3. The abrasive body according to claim 1, wherein the resin structure is made of resin including at least one material selected from a group of polyvinyl fluoride, vinyl fluoride-hexafluoropropylene copolymer, polyvinylidene fluoride, vinylidene fluoride-hexafluoropropylene copolymer, polyethylene and polymethyl methacrylate.

4. The abrasive body according to claim 1, wherein the abrasive grains are made of at least one material selected from a group of silicon oxide, cerium oxide, aluminum oxide, zirconium oxide, titanium oxide, manganese oxide, barium carbonate, chromium oxide and iron oxide.

5. The abrasive body according to claim 1, which is made in a form of a disc.

6. The abrasive body according to claim 2, wherein the resin structure is made of resin including at least one material selected from a group of polyvinyl fluoride, vinyl fluoride-hexafluoropropylene copolymer, polyvinylidene fluoride, vinylidene fluoride-hexafluoropropylene copolymer, polyethylene and polymethyl methacrylate.

7. The abrasive body according to claim 2, wherein the abrasive grains are made of at least one material selected from a group of silicon oxide, cerium oxide, aluminum oxide, zirconium oxide, titanium oxide, manganese oxide, barium carbonate, chromium oxide and iron oxide.

8. The abrasive body according to claim 2, which is made in a form of a disc.

* * * * *